US008434529B2

(12) United States Patent
Goldbrunner

(10) Patent No.: US 8,434,529 B2
(45) Date of Patent: May 7, 2013

(54) FILLING DEVICE FOR CONTAINERS

(75) Inventor: Christian Goldbrunner, Au I.d. Hallertau (DE)

(73) Assignee: Krones AG, Neutraubling (DE)

( * ) Notice: Subject to any disclaimer, the term of this patent is extended or adjusted under 35 U.S.C. 154(b) by 579 days.

(21) Appl. No.: 12/667,802

(22) PCT Filed: Jul. 9, 2008

(86) PCT No.: PCT/EP2008/005606

§ 371 (c)(1),
(2), (4) Date: Apr. 21, 2010

(87) PCT Pub. No.: WO2009/015747

PCT Pub. Date: Feb. 5, 2009

(65) Prior Publication Data

US 2010/0307639 A1 Dec. 9, 2010

(30) Foreign Application Priority Data

Jul. 31, 2007 (DE) ..... 10 2007 035 872

(51) Int. Cl.
*B65B 31/00* (2006.01)

(52) U.S. Cl.
USPC ..... 141/59; 141/263; 141/374

(58) Field of Classification Search ..... 141/59, 141/250, 251, 263, 284, 301, 374
See application file for complete search history.

(56) References Cited

U.S. PATENT DOCUMENTS

| | | | | |
|---|---|---|---|---|
| 4,653,551 | A | 3/1987 | Sindermann | |
| 6,280,124 | B1 * | 8/2001 | Ammann | 408/129 |
| 6,329,728 | B1 | 12/2001 | Kitazawa et al. | |

FOREIGN PATENT DOCUMENTS

| | | | |
|---|---|---|---|
| DE | 3446500 | A1 | 8/1986 |
| DE | 4102633 | A1 | 11/1991 |
| DE | 19855975 | C1 | 3/2000 |
| DE | 202005007446 | | 12/2005 |
| DE | 102004054491 | A1 | 5/2006 |
| DE | 102005031319 | A1 | 1/2007 |
| DE | 102006055375 | A1 | 5/2007 |

OTHER PUBLICATIONS

German Search Report for 10 2007 035 872.7 dated Jun. 10, 2008.

* cited by examiner

*Primary Examiner* — Gregory Huson
*Assistant Examiner* — Jason K Niesz
(74) *Attorney, Agent, or Firm* — Marshall, Gerstein & Borun LLP

(57) ABSTRACT

A filling device for beverage bottles, having a filling valve by way of which different media, including a product to be bottled, can be supplied and/or discharged, and a return gas pipe that is displaceable in linear fashion relative to the filling valve by means of an electromagnetic positioning drive. The positioning drive is a linear motor having a stationary stator housing and a rotor coupled to the return gas pipe.

15 Claims, 1 Drawing Sheet

FILLING DEVICE FOR CONTAINERS

CROSS-REFERENCE TO RELATED APPLICATION

The present application claims the benefit of priority of International Patent Application No. PCT/EP2008/005606, filed Jul. 9, 2008, which application claims priority of German Patent Application No. 10 2007 035 872.7, filed Jul. 31, 2007. The entire text of the priority application is incorporated herein by reference in its entirety.

FIELD OF THE DISCLOSURE

The present disclosure relates to a filling device for containers, such as in beverage bottling operations.

BACKGROUND

Since in a filling device the return gas pipe with its relative height position in the filling valve serves not only to precisely adjust the filling level in the container, but also plays an important role in flushing operations and/or in cleaning processes, and since bottlers often want to set different height positions of the return gas pipe, if possible without any external intervention, when changing between different container types, the well-known solution, i.e. to exchange return gas pipe end sections of different lengths, is too complicated and time-consuming, and a process has therefore been adopted in which the return gas pipe is adjusted by means of a positioning drive in a selective way and as required.

In the filling device known from DE 10 2005 031 319 A, the return gas pipe that is supported against rotation comprises an external thread meshing with an internal thread of a ring rotatably supported in the valve housing. A permanent magnet ring which electromagnetically cooperates through the wall of the valve housing with a stator that is stationarily arranged on the outside is positioned on the ring. Magnetic alternating fields that are rotating the ring and screw the return gas pipe in place are generated via the stator. Although this solution avoids any passages with seals (great constructional efforts, difficult cleaning operations, risk of leakage), noticeable electromagnetic losses and relatively great mechanical losses caused by the thread connection and the anti-rotation of the return gas pipe must certainly be accepted. The components for a precise mechanical conversion of rotational movements into linear movements lead not only to great mechanical losses, but, since they are exposed to the media in the filling device, they are objectionable in terms of hygiene and complicate the cleaning cycles.

In the filling device known from DE 198 55 975 C a permanent magnet ring is fixed to the return gas pipe, the ring electromagnetically cooperating through a chamber wall with a permanent magnet positioned outside the chamber. The outer permanent magnet is linearly adjusted in a mechanical way, dragging along the return gas pipe via the inner permanent magnet ring. However, this necessitates a mechanical passage that poses the known sealing and assembling problems. As an alternative, the return gas pipe can be directly coupled by mechanical actuation, but this requires a passage between zones of different pressures and different media. A further solution suggests an extended chamber leading to the outside for the return gas pipe, and a linearly adjustable permanent magnet that is positioned outside the extension and cooperates with the permanent magnet ring on the return gas pipe through the chamber wall. The precision that is achievable in adjusting operations is not always satisfactory because due to the transmission of the magnetic forces through a wall and because of the large gap the inner permanent magnet ring cannot follow the outer one in a very reliable way.

SUMMARY OF THE DISCLOSURE

It is the object of the present disclosure to provide a filling device of the aforementioned type, wherein the selective positioning of the return gas pipe at all times can be carried out with little loss and in a precise way.

An electromagnetic linear motor operates with little loss and enables the precise and reproducible adjustment of the return gas pipe without the need for any mechanical passages. The concept is producer- and user-friendly. The linear motor can be completely integrated into the per se closed system of the filling device. With the linear motor it is not only possible to move the return gas pipe into the respectively desired position with relatively little loss, but to position and fix the return gas pipe also in a precisely reproducible way. This is accomplished electromagnetically without any relative rotary movements, without sealing problems and without an interposed wall.

The linear motor can be mounted with simple and permanent seals that can be easily cleaned. It is here essential that the linear motor itself defines a pressure-resistant chamber of the filling device that can be accessed by media, so that in the magnetic force path there is no need for a wall or a very large gap.

Expediently, the linear motor is a commercial linear motor that is modified for use in the filling device only such that it comprises food-grade surface linings that are resistant to the processed media and that are otherwise not needed for the standard uses of such linear motors. This modification of the linear motor can be realized by taking relatively small efforts and converts the linear motor into a positioning drive that can ideally be integrated into the filling device.

Expediently, the stator housing and the rotor are lined with stainless steel without the formation of any undercuts or openings that are difficult to clean.

In a particularly expedient embodiment the linear motor with its rotor bore is a functional component of the filling device because it is used for the supply and discharge of at least one medium. Since in such filling devices specific dimensions and/or distances are often provided in the direction of the return gas pipe at any rate between the individual active and passive components, the linear motor can gainfully exploit this circumstance, i.e. it can be easily integrated without any significant modifications in the overall concept.

For instance, the stator housing is mounted between a connection body, preferably for vacuum application and/or pressure relief of the container needed under specific filling conditions, and the valve body itself. Thus the linear motor permits a perfect, precise and quickly responding positioning of the return gas pipe on the one hand and the supply or discharge of a medium in response to the needs on the other hand.

In an expedient embodiment, the rotor is arranged with a play in the rotor bore and guided e.g. on both ends via guide elements in the rotor bore. The guide elements, however, define at least one medium passage with the inner wall of the rotor bore. Optionally, the medium passage or another medium passage is also provided, separated from the rotor bore, in the stator housing at an appropriate position, so that the linear motor can fulfill this secondary function.

Expediently, the control electronics of the linear motor is already contained in the stator housing, so that only connection lines (possibly with signal lines) have to be installed. The control electronics may here already comprise a program section, or the like.

Expediently, a coupling is provided between the return gas pipe and the rotor so as to be able to separate these members at any time. Preferably, this coupling is releasable. This also facilitates the assembly of the filling device.

The coupling should have smaller dimensions than the rotor bore, so that the coupling can be moved with at least one section of the return gas pipe into the rotor bore. This reduces the overall length and exploits the space that is available at any rate due to the working stroke of the rotor.

Expediently, the rotor stroke is up to about 100 mm. With such a large stroke, it is possible not only to raise the return gas pipe, e.g. to facilitate the lateral insertion or removal of a container or the cleaning operation, but it is also possible to adjust many different depth positions of the return gas pipe in response to the respectively desired filling level in the container, and finally it is possible to lower the return gas pipe to a very low level in a particularly advantageous way, which may be expedient for flushing operations in which the return gas pipe as an active component e.g. with a gas can intensify the flushing operation in the container.

Due to the universal applicability of the linear motor the return gas pipe can even be lowered in every filling cycle, e.g. by way of corresponding programming, first into a flushing position at a low level so as to intensify the flushing action and it is only then that it is adjusted to the filling level.

BRIEF DESCRIPTION OF THE DRAWINGS

An embodiment of the subject matter of the invention shall now be explained with reference to the drawings, in which.

DETAILED DESCRIPTION OF THE PREFERRED EMBODIMENT

Figure 1:
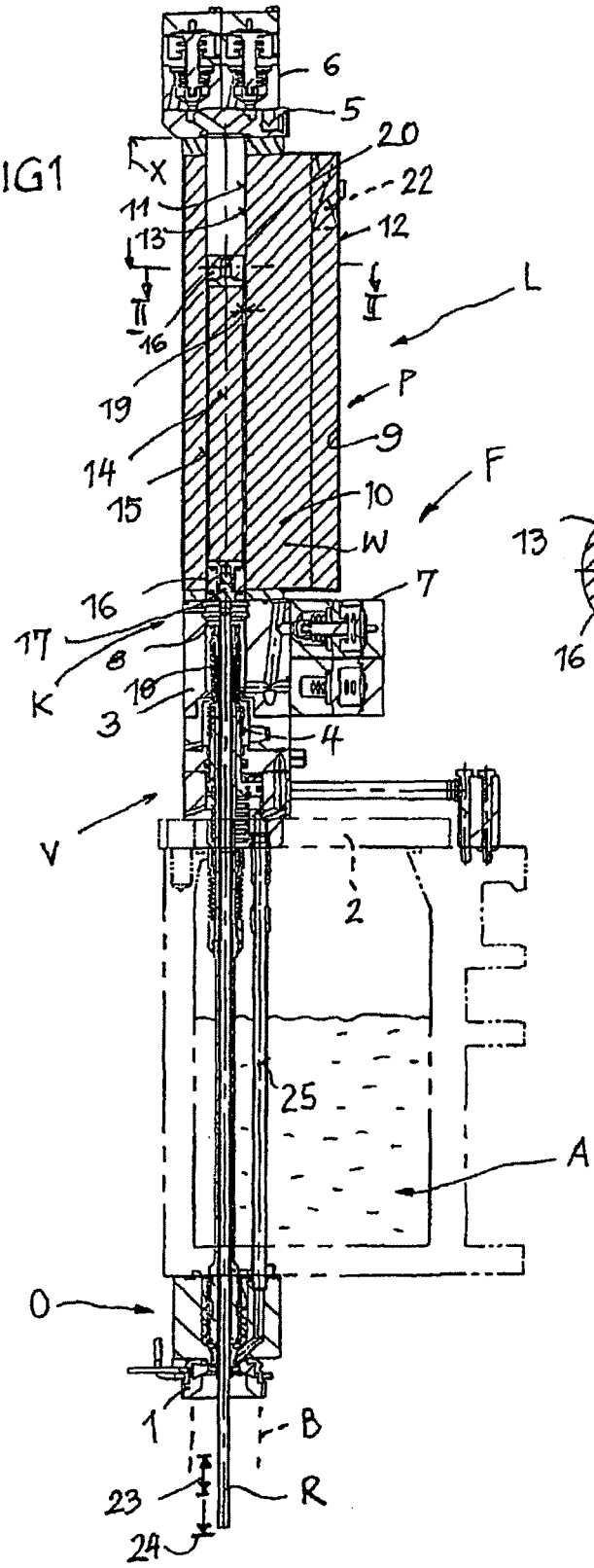
FIG. 1 is a schematic sectional view of a filling device having an integrated electric linear motor.
Figure 2:
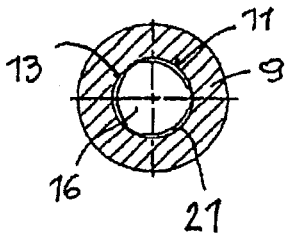
FIG. 2 is a detail section taken in the sectional plane II-II in FIG. 1.

A filling device F shown in FIGS. 1 and 2 serves, for instance, to fill containers B, such as plastic or gas bottles, with drinks. Filling methods are here adopted, as are e.g. explained in DE 20 2005 07 446 U1. The filling device described hereinafter is based on this known prior art also constructionally.

The filling device F is e.g. supported by means of a supporting structure 2 (tank top side) on a filler ring tank, which is continuously rotatingly drivable about a vertical axis, and comprises a lower filling cone 1 against which the respective container B is pressed from below. A filling unit O designed in conformity with DE 20 2005 007 446 U1 (FIG. 1) with a liftable and lowerable valve body and a swirl body formed on the outside is arranged on the bottom side of the filler ring tank. A return gas pipe R which is linearly adjustable in the filling device F and is responsible in a manner known per se for the final fill level inside the container B insofar as it will prevent any further filling with a product as soon as the lower opening of the return gas pipe R immerses into the product, whereby the return gas path is closed, projects through the filling cone 1. The supporting structure 2 supports a valve housing 3 through which the return gas pipe R is axially passed and which contains valve components that are not explained in more detail. For example, schematically depicted valves 7 are mounted on the valve housing 3. For the exchange of gas the valve housing 3 communicates, via an axially aligned channel, with an at least partly filled ring tank A which is positioned at a lower level and used for the product to be filled, and a gas, such as $CO_2$, is kept in a pressurized state in the ring tank above the product level. In the valve housing 3, a schematically depicted plastic bellows 18 for sealing the movable return gas pipe R is positioned in said channel.

At a distance above the valve housing 3 a connection body 5 is arranged, optionally with further valves 6, the connection body including flow paths e.g. for a cleaning medium and/or for vacuum application and/or pressure relief of the container B.

An electric linear motor L is installed between the connection body 5 and the valve housing 3 as a positioning drive P for the respective height position of the return gas pipe R. The linear motor L comprises an elongated stationary stator housing 9 with a rotor bore 11 passing axially therethrough, and is provided in an inner chamber 10 with at least one stator winding W which can be energized. The stator housing 9 is provided on the outside, optionally also in the rotor bore 11, with a lining or coating 12, 13, which is resistant to the media processed in the filling device F and food-approved and is e.g. made of stainless steel.

Optionally, the outer lining 12 is recessed at the place where the linear motor L is mounted on the valve housing 3 and on the connection body 5, respectively.

In the rotor bore 11 a rotor 14 is linearly movably guided with a radial play 19, e.g. by means of guide bodies 16 fixed on both ends on coupling elements 20, which are e.g. made of polytetrafluoroethylene. The rotor 14 is optionally also provided with a lining or coating, e.g. of stainless steel. The guide elements 16 (FIG. 2) form media passages 21 with the inner wall of the rotor bore 11, so that, despite the fact that the rotor 14 is accommodated in the rotor bore 11, medium flows are possible in the one and/or other direction past the rotor 14. The rotor 14 contains one or several magnets (not shown), preferably permanent magnets, which are e.g. produced by using rare earths.

For instance, as has already been mentioned, vacuum application and/or pressure relief of the container B is carried out, for example through the rotor bore 11, if fundamentally desired, or a cleaning medium is passed therethrough so as to discharge impurities for example via a discharge chamber 8 in the valve housing 3 and optionally via a lateral bore leading to the exterior.

The useable linear stroke of the rotor 14 is indicated with a dimension X and amounts e.g. up to about 100 mm.

The rotor 14 is connected to the return gas pipe R via a coupling K, the coupling K being expediently releasable. The coupling K may be provided on an insert 17 which can be screwed into the rotor 14.

With the help of the linear motor L the return gas pipe R is optionally adjustable in the direction of the double-headed arrow 23 and fixable in the respectively adjusted position. Optionally, the return gas pipe R is even lowered into a flushing position 24 positioned at a low level so as to flush the container particularly thoroughly in each filling cycle (before), e.g. with $CO_2$ from the container for the product to be filled. When a pre-stressing pressure is applied, a pre-stressing line 25 can be guided in parallel with the return gas pipe R up and into the filling unit O positioned thereunder.

The linear motor L may be a commercial linear motor that is only, as has been mentioned, provided with special steel linings. Such linear motors are freely available in different specifications and are modified accordingly either by their manufacturer or by the manufacturer of the filling device and comprise only two connection sockets on a base of the stator housing 9, to which cables can be connected. Expediently, a control electronics 22 for the linear motor is already accommodated in the stator housing 9, optionally with a program section. In this way the linear motor can be easily integrated into the electric or electronic control system of the filling device so as to control the two functions, i.e. the function of the positioning of the return gas pipe R and optionally also the function of a medium supply or discharge.

In an alternative (not shown), the linear motor L might only be mounted on the valve housing 3 without the connection body 6 attached at the top. The linear motor could then be flushed optionally from below for cleaning purposes. This could be expedient in filling devices that operate without any vacuum application and/or pressure relief, or use another system for this.

As a rule, the electric linear motor L could be integrated as a positioning drive of a return gas pipe R also into differently conceived filling devices than the one shown, because the function of the positioning of the return gas pipe is fully independent of the technique employed in the filling device.

The invention claimed is:

1. A filling device for containers, particularly beverage bottles, comprising a filling unit by way of which different media, including a product to be bottled, can be one of supplied, discharged, or a combination thereof, and a return gas pipe which is contained in the filling unit and is displaceable in linear fashion relative to the filling valve by means of an electromagnetic positioning drive, the electromagnetic positioning drive (P) being a linear motor composed of a stationary stator housing including at least one linear motor winding and of a rotor coupled to the return gas pipe and arranged in the stator housing in a rotor bore, wherein the linear motor is a commercial linear motor formed with one of inner, outer, or combination inner and outer food-grade surface linings that are resistant to the media processed in the filling device, and wherein the linear motor with the stator housing and the rotor bore is constructionally integrated into the filling device with formation of a flow path for at least one medium.

2. The filling device according to claim 1, wherein the stator housing is lined with stainless steel.

3. The filling device according to claim 1, wherein the stator housing is mounted between a connection body and a valve housing having the return gas pipe (R) passing therethrough.

4. The filling device according to claim 1, wherein the rotor is arranged with a play in the rotor bore and is guided via guide elements which with an inner wall of the rotor bore define a medium passage extending between both ends of the stator housing.

5. The filling device according to claim 1, and wherein a control electronics of the linear motor is contained in the stator housing.

6. The filling device according to claim 1, wherein a coupling is provided between the return gas pipe and the rotor.

7. A filling device for containers, particularly beverage bottles, comprising a filling unit by way of which different media, including a product to be bottled, can be one of supplied, discharged, or a combination thereof, and a return gas pipe which is contained in the filling unit and is displaceable in linear fashion relative to the filling valve by means of an electromagnetic positioning drive, the electromagnetic positioning drive (P) being a linear motor composed of a stationary stator housing including at least one linear motor winding and of a rotor coupled to the return gas pipe and arranged in the stator housing in a rotor bore, wherein the coupling is provided between the return gas pipe and the rotor, and wherein said coupling has dimensions smaller than those of the rotor bore, and can be moved with at least a section of the return gas pipe into the rotor bore.

8. The filing device according to claim 1, and wherein the rotor stoke of the linear motor is up to about 100 mm.

9. A filling device for containers, particularly beverage bottles, comprising a filling unit by way of which different media, including a product to be bottled, can be one of supplied, discharged, or a combination thereof, and a return gas pipe which is contained in the filling unit and is displaceable in linear fashion relative to the filling valve by means of an electromagnetic positioning drive, the electromagnetic positioning drive (P) being a linear motor composed of a stationary stator housing including at least one linear motor winding and of a rotor coupled to the return gas pipe and arranged in the stator housing in a rotor bore, wherein in every filling cycle of the filling device the linear motor either one of programs the return gas pipe or drives it into different positions, the various positions being variable in response to time or, in the case of a rotating filling device, in response to the distance, expediently through a control electronics which may directly be assigned to the linear motor.

10. The filling device according to claim 3, wherein the rotor is lined with stainless steel.

11. The filling device according to claim 3, wherein the connection body is for one of vacuum application, pressure relief, or a combination thereof for the container.

12. The filling device according to claim 3, wherein the return gas pipe is for one of return-gas, product flow, prestressing-medium flow, correction-medium flow, or combinations thereof.

13. The filling device according to claim 4, wherein the rotor is guided at both ends.

14. The filling device according to claim 6, wherein the coupling is a releasable coupling.

15. The filling device according to claim 9, wherein one of the different positions is for lowering the return gas pipe down into a flushing position provided at a low level.

* * * * *